United States Patent [19]

Shuey

[11] Patent Number: 4,687,264

[45] Date of Patent: Aug. 18, 1987

[54] DUAL SLOT ELECTRICAL CONTACT AND METHOD OF MAKING SAME

[75] Inventor: John R. Shuey, Mechanicsburg, Pa.

[73] Assignee: AMP Incorporated, Harrisburg, Pa.

[21] Appl. No.: 882,047

[22] Filed: Jul. 3, 1986

[51] Int. Cl.[4] ..... H01R 4/66

[52] U.S. Cl. ..... 439/92; 29/860; 29/874; 439/880

[58] Field of Search ..... 29/861, 874, 860; 339/14 R, 276 R, 276 S, 276 T, 296 SF, 95 R

[56] References Cited

U.S. PATENT DOCUMENTS 4,491,381 1/1985 Hamsher et al. ..... 339/14 R X 4,602,830 7/1986 Cockard ..... 339/14 R

*Primary Examiner*—Eugene F. Desmond

*Attorney, Agent, or Firm*—Anton P. Ness

[57] ABSTRACT

A contact terminal has a termination section at one end thereof including a spaced pair of axially-extending slots within each of which a respective one of a pair of conductor wires is held in interference fit for weld termination such as by laser welding. The terminal can be a ground terminal for the pair of ground conductors of a tri-lead cable. The terminal is stamped from a metal blank and its termination section is formed by striking an axially extending boss upwardly in the center thereof having parallel vertical side surfaces and a selected width, and bending parallel vertical sidewalls upward from side portions of the termination section spaced selected distances from the side surfaces of the central boss. The sidewalls may be higher than the top of the central boss and contain inwardly directed rounded bosses which hold the conductor wires in the respective slots prior to weld termination.

14 Claims, 10 Drawing Figures

DUAL SLOT ELECTRICAL CONTACT AND METHOD OF MAKING SAME

FIELD OF THE INVENTION

This relates to the field of electrical connectors and more particularly to contact terminals for conductor termination.

BACKGROUND OF THE INVENTION

Electrical contact terminals are known which are used to terminate a pair of conductors in a single slot by welding, particularly by laser welding. Such contact terminals are known from U.S. Pat. No. 4,579,404 for use in a single-row electrical connector for terminating the pairs of ground conductors in tri-lead high speed signal transmission cables. A similar but double row connector is known from U.S. patent application Ser. No. 754,785 filed Jul. 12, 1985 and assigned to the assignees hereof. Such terminals require the pairs of ground conductors to be brought together side-by-side near the top of the slot and in interference fit therein for termination remote from the respective signal conductors of the cables. The signal conductors are separately but similarly terminated to respective signal terminals insulated from the ground terminals by the dielectric carrier to which the terminals are secured, and the entire conductor-terminated subassembly is then overmolded forming the connector. Contact sections of the terminals are disposed at the forward end of the connector, ready for electrical engagement with corresponding terminal means of a mating electrical connection means.

When the side-by-side conductors are laser welded, the area of the weld joint of course is wider than if a single conductor were being welded in a correspondingly narrower slot. In both cases the weld joint must join to the sidewalls of the slot whose top surfaces are preferably approximately coplanar with the top portions of the conductor or conductors for optimizing the laser weld termination. However, a typical conductor diameter is about 0.010 inches and the corresponding weld joint for the side-by-side conductors is about 0.040 to 0.045 inches in diameter. A smaller weld joint for only one such conductor requires less energy of the laser beam during welding and a lower energy level incurs less risk of damaging the very small conductor wire.

From U.S. Pat. No. 4,602,831 (for a single-row connector) and application Ser. No. 754,784 filed July 12, 1985 (for a double-row connector), both assigned to the assignee hereof, it is known to place individual signal terminals along one side of a dielectric contact carrier, and a single ground plane on the other side of the carrier. In U.S. Pat. No. 4,602,831 all ground conductors of the single row of tri-lead cables (or a tri-lead cable) are terminated to the ground plane, singly in respective single width slots by welding such as laser welding. In Ser. No. 754,784 each row of cables (or each flat cable) has a contact carrier associated with it having signal terminals on one side and a single ground plane on the other, with each slot of the ground plane receiving a pair of side-by-side ground conductors therein for laser weld termination. Either ground plane is formed by first stamping the plurality of slots in a metal blank near one side edge of the blank, then folding over a portion of the blank along that side edge so that the slots now extend out to the newly formed edge to receive the conductor or pair of conductors. But with either ground plane all grounds of a row of cables (or of the flat cable) are terminated only on the same side of the carrier, and each row of cables or flat cable requires its own contact carrier. Thus, either type of ground plane delimits or complicates the programmability of a double-row connector, and cannot be used in the double-row connector of aforementioned Ser. No. 754,785.

It is desired to provide a contact for two conductor wires which includes a separate slot for each conductor, each for receiving a respective one of the conductors for individual weld termination, as disclosed in U.S. patent application Ser. No. 882,048 filed July 3, 1986 (concurrently herewith) and assigned to the assignee hereof.

SUMMARY OF THE INVENTION

A stamped and formed contact terminal with a contact section proximate one end thereof, has a spaced pair of parallel slots extending inwardly from the other end thereof to receive respective conductors for force-fit thereinto to be held for weld termination such as by laser welding. Each slot has a width slightly less than the diameter of the conductor and holds its conductor so that the top most portion of its conductor is approximately coplanar with the top of at least one side of the slot.

The dual slot terminal of the present invention is made by stamping a terminal blank including a contact section and a termination section rearwardly therefrom. A central boss is stamped upwardly from said termination section having a precisely selected width and precise parallel vertical side surfaces. In one embodiment side portions of the termination section are bent upwardly forming parallel low height vertical sidewalls spaced from the side surfaces of the central boss a selected distance to define a pair of slots of precise width. The top surface of the central boss is preferably coplanar with the top surface portions of the conductor wires disposed along the slots, and edges of at least the sidewalls along the slots are preferably swaged. In another embodiment rounded bosses extend inwardly from high sidewalls to secure the conductors in the slots below the rounded bosses, with the top surface portions of the conductor wires coplanar with the top of the central boss.

It is an objective of the present invention to provide a dual slot terminal and a method for making such a terminal with slots of precisely controlled width for holding respective conductors in interference fit therein for laser weld termination.

DETAILED DESCRIPTION OF THE PREFERRED EMBODIMENT

Figure 1:
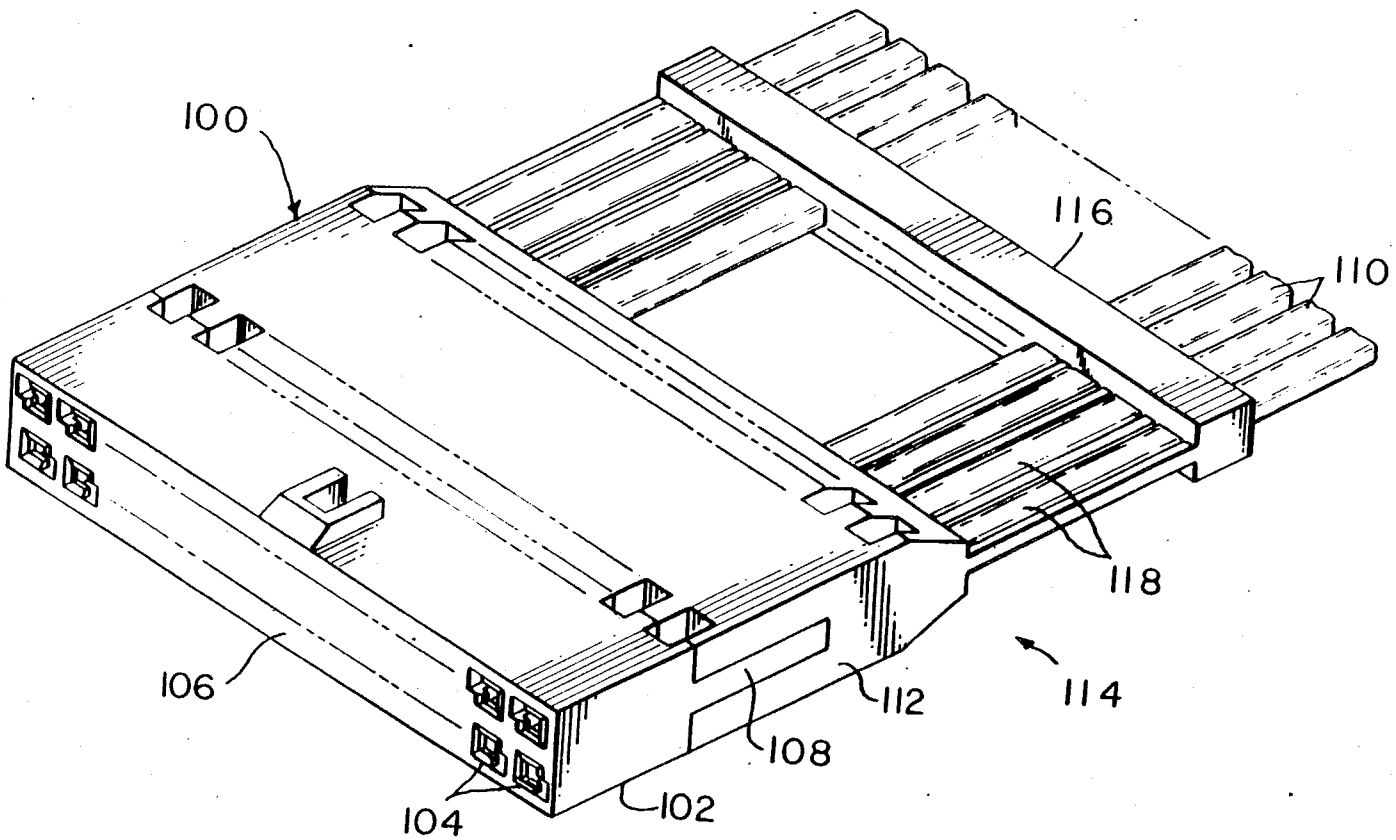
FIG. 1 is a double-row connector for signal transmission cable in which the present invention may be used.

In FIG. 1 is shown an electrical connector such as that of U.S. Ser. No. 754,785. Connector 100 comprises a terminal assembly 102 having a plurality of terminals disposed in passageways 104 extending rearwardly from the mating face 106 of the connector. Rearward sections of the temrinals (not shown) extend along a contact-carrying portion 108 of the terminal assembly and are terminated to conductors of cables 110. A dielectric covering 112 is overmolded over the terminal assembly sealing the terminations and extending along cables 110 securing the cables to the connector to form a cable harness 114 and provide nondistorting strain relief. Also seen is a transverse bar 116 spaced rearwardly from covering 112 and joined to it by axial webs 118, bar 116 also being molded over the cables integrally with covering 112 and providing secondary nondistorting strain relief for the cables and also spacing and supporting them.

Figure 2:
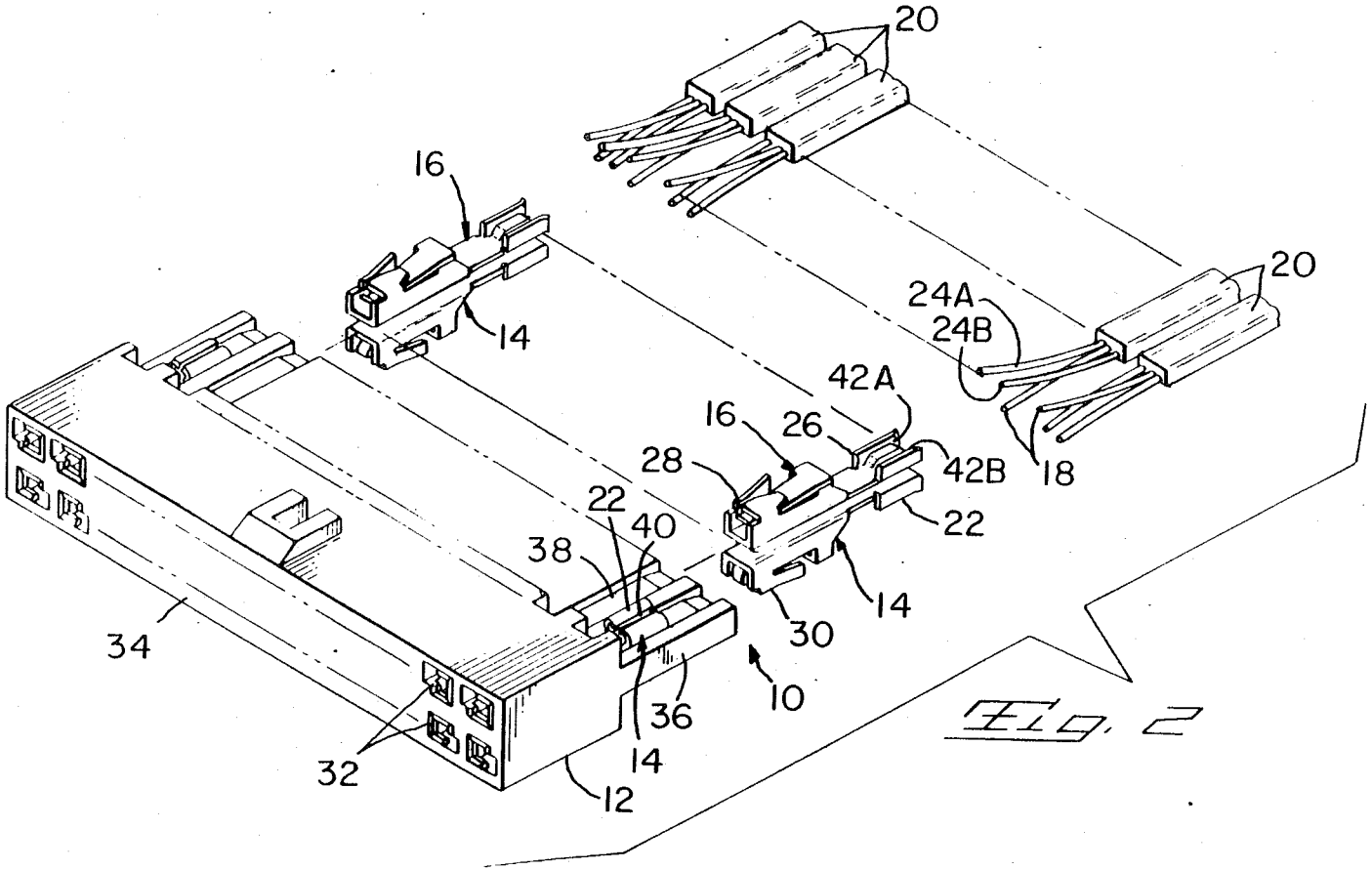
FIG. 2 is an exploded view of a terminal assembly usable with the electric connector of FIG. 1, using the dual slot terminal of the present invention.

FIG. 2 shows a terminal assembly 10 usable in such a connector, which assembly comprises a premolded forward housing member 12, signal terminals 14 and ground terminals 16. Signal conductors 18 of cables 20 are stripped to be terminated to termination sections 22 of signal terminals 14, and pairs of ground conductors 24A,24B of cables 20 and stripped to be terminated to termination sections 26 of ground terminals 16. Contact sections 28 of ground terminals 16 are identical to contact sections 30 of signal terminals 14 and will be disposed along and secured within passageways 32 of housing 12 which extend from housing mating face 34 to contact-carrying portion 36. Termination sections 22,26 of signal and ground terminals 14,16 extend along contact-carrying portion 36, preferably in shallow recesses 38 thereof. Terminal assembly 10 is assembled by securing contact sections 28,30 of terminals 14,16 within passageways 32 of housing 12, then terminating conductors 18,24A,24B to appropriate ones of terminals 14,16, and thereafter molding a dielectric covering over the contact-carrying portion, the terminals and stripped conductors, and along end lengths of the cables. During overmolding, rear ends of passageways 32 are closed off by core pins in the mold which also hold terminals 14,16 firmly against the respective top or bottom surface of contact-carrying portion 36 of housing 12.

Each signal termnal 14 preferably includes a single conductor-receiving slot 40 which is of a width just less than the diameter of a corresponding signal conductor 18. Signal conductor 18 is then wiped carefully along and into slot 40 by appropriate apparatus such as that disclosed in U.S. patent application Ser. No. 784,276 filed Oct. 4, 1985 assigned to the assignee hereof. Signal conductor 18 will be held by interference fit within slot 40 until being welded therein such as preferably by laser welding.

Figure 3:
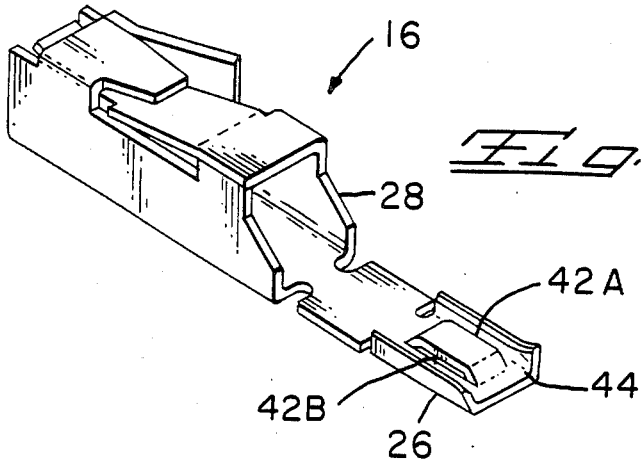
FIG. 3 is an enlarged view of the embodiment of the dual slot terminal of FIG. 2.

Each ground terminal 16, best seen in FIG. 3, includes a spaced pair of parallel conductor-receiving slots 42A,42B extending forwardly from a rearward end 44 of terminal 16.

Within each slot 42A,42B will be wiped a respective ground conductor 24A,24B as with signal condcutor 18 in slot 40 of signal terminal 14 above. Best seen in FIGS. 5A,5B and 6, slots 42A,42B are slightly less wide than the diameter of respective ground conductors 24A,24B, to hold them in interference fit therein until being welded therein such as preferably by laser welding. Slots 42A,42B preferably have lead-ins to assist in receiving a respective conductor being wiped thereinto and minimize possible damage to the conductor wire which may typically have a diameter of about 0.010 inches.

Figure 4A:
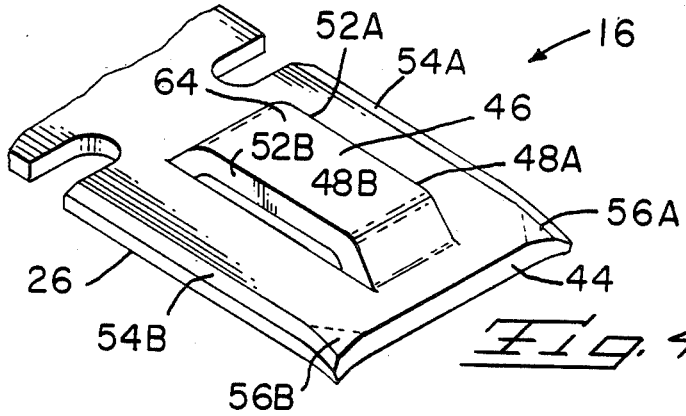
FIGS. 4A and 4B illustrate the forming of the termination section of the dual slot terminal of FIG. 2.
Figure 4B:
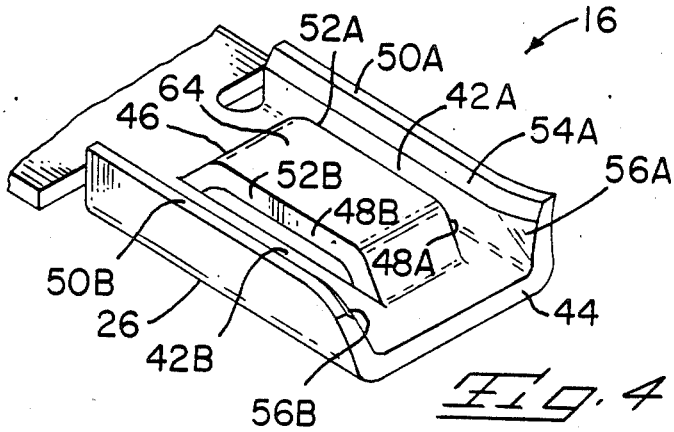

As shown in FIGS. 4A and 4B, terminal 16 is stamped from a sheet of metal such as phosphor-bronze alloy, Copper Alloy 511 having a thickness for example of 0.008 inches. The contact section may be of the receptacle type 28 shown in FIG. 3. Termination section 26 has a central boss 46 stamped upwardly therefrom which extends axially and has precise parallel vertical side surfaces 48A,48B and a substantially planar top surface 64. Sidewalls 50A, 50B are formed bent upwardly opposed from side surfaces 48A,48B to define slots 42A,42B. Edges 52A,52B may be deburred, and swaging of edges 54A,54B and either swaging or bending or both of corners 56A,56B is preferred to form axially extending lead-ins and initial lead-ins respectively to assist wiping of respective conductor wires into slots 42A,42B.

Figure 5A:
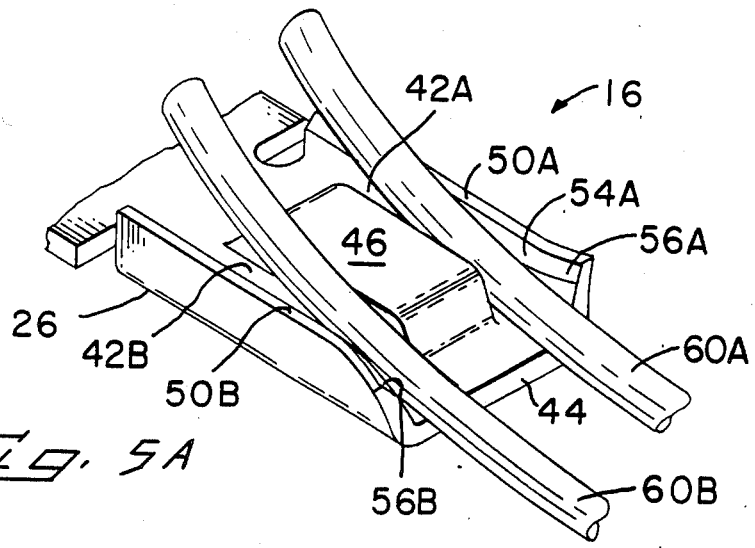
FIGS. 5A and 5B illustrate the placement of conductors in the slots of the terminal of FIG. 2 and weld termination of one of them.
Figure 5B:
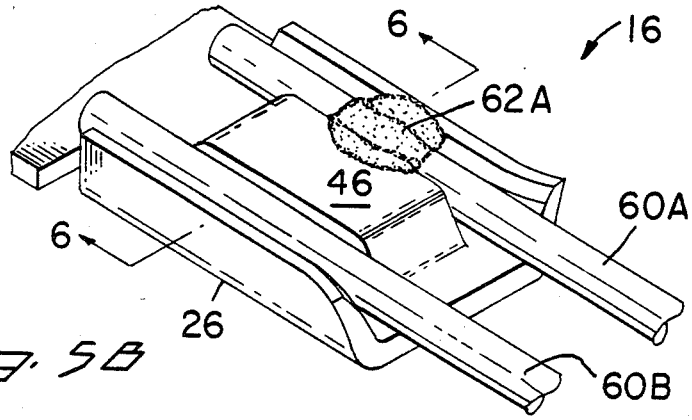
Figure 6:
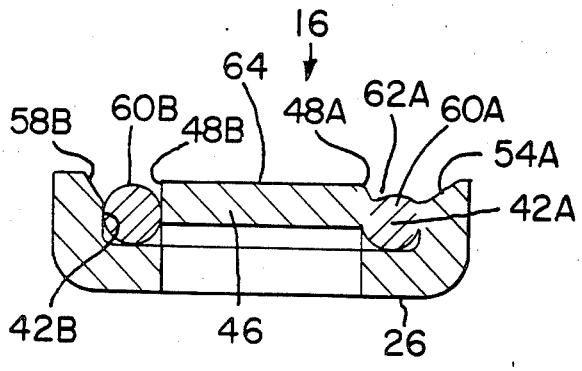
FIG. 6 is a cross-sectional view taken along lines 6—6 of FIG. 5B and showing the laser weld termination joint of one of the conductors.

In FIGS. 5A and 5B stripped conductors 60A,60B are shown first partially wiped into interference fit within respective slots 42A,42B, and then fully wiped thereinto. Conductor 60A is shown terminated by weld joint 62A which is preferably a laser weld joint. FIG. 6 illustrates conductors 60A,60B in inteference fit between sides 48A,48B of central boss 46 and respective opposing sidewalls 50A,50B and showing weld joint 62A of conductor 60A to terminal 16.

Figure 7:
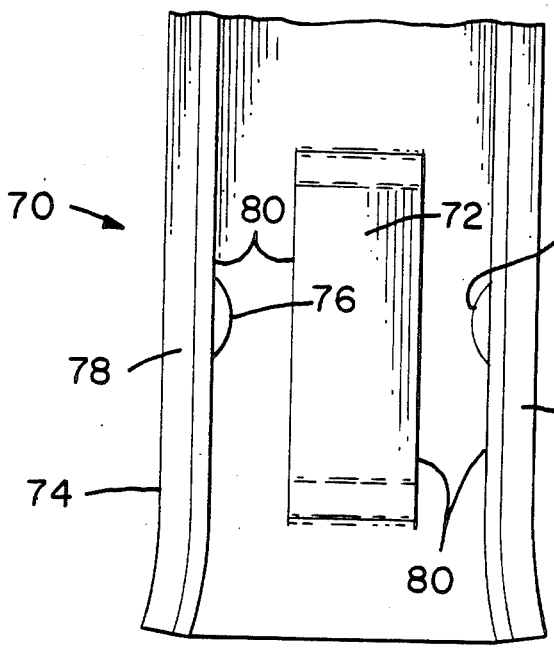
FIGS. 7 and 8 illustrate another embodiment of the present invention.
Figure 8:
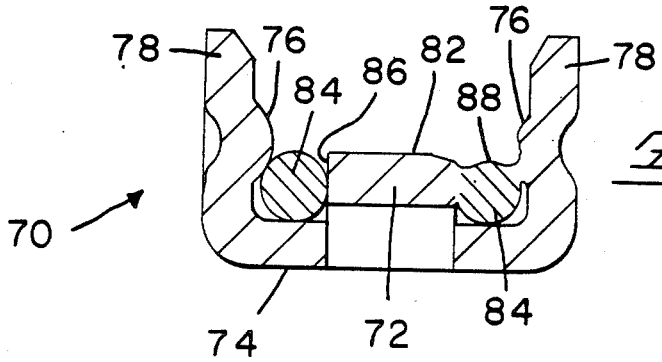

In FIGS. 7 and 8 another embodiment of the present invention is shown. Dual slot terminal 70 has a central boss 72 struck up from termination section 74. Rounded bosses 76 are struck upward from side portions of termination section 74. Sidewalls 78 are then bent vertically upwardly from the side portions forming slots 80 such that rounded bosses 76 extend inwardly centered slightly above the plane of top surface 82 of central boss 72. When condcutor wires 84 are wiped along and into slots 80, each wire 84 is forced downward between a rounded boss 76 and side surface 86 of central boss 72 and is held in slot 80 by rounded boss 76. FIG. 8 also shows a laser weld joint 88 of one of the conductor wires 84 to terminal 70.

The dual slot terminal of the present invention can be made with minor variations without departing from the spirit of the invention and the scope of the claims. Such a terminal would most commonly be used as a ground terminal for a tri-lead cable to receive a pair of ground wires associated with the same signal conductor. But the terminal can be used to receive ground conductors from two cables, or even signal conductors from two different cables were it be desired for the terminal to conduct an electrical signal from either one of a pair of cables.

What is claimed is:

1. A contact terminal for terminating two small diameter conductor wires without substantially distorting the conductor wires comprising a forward contact section and a rearward termination section, said rearward termination section including a spaced pair of conductor-receiving slots extending forwardly from a rearward end thereof, inner walls of said slots defined by parallel vertical side surfaces of a central boss of selected width struck upwardly from said termination section, and outer walls of said slots comprised of parallel side walls of said termination section bent vertically upwardly from side portions thereof and having inside surface portions spaced from respective said side surfaces of said central boss defining respective said conductor-receiving slots, said side walls having inwardly directed rounded bosses centered above adjacent top surface portions of said central boss and spaced from said central boss side surfaces distances selected to be just less than the diameter of a respective conductor wire, and said slots each having a depth below said rounded bosses approximately equal to the diameter of a said conductor wire, so that top portions of a said conductor wire disposed therein are approximately coplanar with said adjacent top surface portions of said central boss, such that said conductor wires are forceable between said rounded bosses and said central boss during wiping of said wires into respective said slots and are holdable thereby in said slots for laser weld termination.

2. A contact terminal for terminating two small diameter conductor wires without substantially distorting the conductor wires comprising a forward contact section and a rearward termination section, said rearward termination section including a spaced pair of conductor-receiving slots extending forwardly from a rearward end thereof, inner walls of said slots defined by parallel vertical side surfaces of a raised central section of selected width, and outer walls of said slots comprised of parallel side walls of said termination section bent vertically upward from side portions thereof and having inside surface portions spaced from respective said side surfaces of said raised central section defining respective said conductor-receiving slots, said side walls having inwardly directed rounded bosses centered above adjacent top surface portions of said raised central section and spaced from said raised central section side surfaces distances selected to be just less than the diameter of a respective said conductor wire, and said slots each having a depth below said rounded bosses approximately equal to the diameter of a said conductor wire, so that top portions of a said conductor wire disposed therein are approximately coplanar with said adjacent top surface portions of said raised central section, such that said conductor wires are forceable between said rounded bosses and said raised central section during wiping of said wires into respective said slots and are holdable thereby in said slots for laser weld termination.

3. A contact terminal for terminating two small diameter conductor wires without substantially distorting the conductor wires comprising a member stamped from a metal blank and formed to have a forward contact section and a rearward termination section, said rearward termination section initially comprising a planar blank portion having a central section and side portions therealong and finally including a spaced pair of conductor-receiving slots extending forwardly from a rearward end thereof, said slots having inner walls defined by parallel vertical side surfaces of a central boss of selected width struck upwardly from said central section, and said slots having outer walls defined by top surface portions of said side portions after said side portions are bent upwardly to be vertically upstanding each a selected distance from a respective one of said side surfaces of said central boss, each said distance selected such that the width of the respective said slot so defined at least at one axial location is just less than the diameter of a respective conductor wire to hold a said wire therein to be terminated by welding.

4. A contract terminal as set forth in claim 3 wherein said slots each have a depth approximately equal to the diameter of a said conductor wire, so that top portions of a said conductor wire are approximately coplanar with adjacent portions of the top surface of at least said central boss when held in a said slot, for laser weld termination.

5. A contact terminal as set forth in claim 4 wherein said side walls have their top surfaces approximately coplanar with said adjacent portions of said top surface of said central boss.

6. A contact terminal as set forth in claim 3 wherein the edges at the tops of at least said outer slot walls are swaged to define lead-ins for wiping thereinto respective said conductor wires.

7. A contact terminal as set forth in claim 3 wherein inside corners of said outer slot walls at said rearward end of said termination section are adapted to comprise initial lead-ins for wiping a said conductor wire thereinto.

8. An arrangement of a contact terminal and two conductor wires prior to establishment of an assured electrical connection therebetween, comprising:

two conductor wires having selected diameters and being exposed for terminating; and a contact terminal stamped from a metal blank and formed to have a forward contact section and a rearward termination section, said rearward termination section initially comprising a planar blank portion having a central section and side portions therealong and finally including a spaced pair of conductor-receiving slots extending forwardly from a rearward end thereof, said slots having inner walls defined by parallel vertical side surfaces of a central boss of selected width struck upwardly from said central section, and said slots having outer walls defined by top surface portions of said side portions after said side portions are bent upwardly to be vertically upstanding each a selected distance from a respective one of said side surfaces of said central boss, each said distance selected such that the width of the respective said slot so defined at least at one axial location is just less than the diameter of a respective said conductor wire, whereby said conductor wires are placed into and physically held in said slots without being substantially distorted thereby to be thereafter welded to establish an assured electrical connection therebetween.

9. An arrangement as set forth in claim 8 wherein said two conductor wires are ground conductor wires associated with the same signal conductor wire of a tri-lead cable means.

10. A method of making a dual slot contact terminal for terminating two conductor wires, comprising the steps of:

stamping a terminal blank from sheet metal having a contact section at a forward end thereof and a termination section at a rearward end thereof, said termination section having a central portion and side portions therealong;

striking rounded bosses upwardly along said side portions of said termination section at selected locations;

striking a central boss upwardly from said central portion of said termination section intermediate said rounded bosses of said side portions, said central boss having a substantially planar top surface and precise parallel vertical side surfaces defining a selected width of said central boss; and forming parallel side walls along said central boss by bending said side portions vertically upwardly having inside surface portions spaced selected distances from said side surfaces of said central boss such that after said forming of said side walls said rounded bosses extend inwardly centered above the plane of said top surface of said central boss, defining parallel slots each having a width between said inwardly directed rounded boss and said side surface of said central boss selected to be just less than the diameter of a respective conductor wire to hold said wire in interference fit therein to be terminated thereto by welding.

11. A method of making a dual slot contact terminal for terminating two conductor wires without substantially distorting said wires, comprising the steps of:

stamping a terminal blank from sheet metal having a contact section at a forward end thereof and a termination section at a rearward end thereof, said termination section of said terminal blank having a central portion and side portions therealong;

striking a central boss of selected width upwardly from said central portion of said termination section such that said central boss has a substantially planar top surface and precise parallel vertical side surfaces defining inner walls of respective conductor-receiving slots; and bending said side portions to be vertically upstanding each a selected distance from a respective said central boss side surface defining outer walls of respective said conductor-receiving slots, each said selected distance being selected such that the width of the respective said slot thus defined at least at one axial location is just less than the diameter of a respective said conductor wire to hold said wire in interference fit therein to be thereafter terminated thereto by welding.

12. A method as set forth in claim 11 further including the step at least prior to said forming step, of swaging top side edges of said side portions of said termination section, whereby an axially extending lead-in is defined by said swaged edges along the tops of said slots after said forming step.

13. A method as set forth in claim 11 further including the step, at least prior to said forming step, of flattening the corners of said termination section of said terminal blank whereby said flattened corners disposed on said side walls after said forming step comprise initial lead-ins for wiping a said conductor thereinto.

14. A method as set forth in claim 11 further including the step of forming said contact section of said terminal blank into a means for electrically engaging a meating electrical terminal means.

* * * * *